United States Patent [19]

Wysocki

[11] 4,214,755

[45] Jul. 29, 1980

[54] BOARD GAME APPARATUS

[76] Inventor: Peggie A. Wysocki, 1490 Wynwood Dr., Cinnaminson, N.J. 08077

[21] Appl. No.: 938,732

[22] Filed: Aug. 31, 1978

[51] Int. Cl.[2] ..... A63F 3/00

[52] U.S. Cl. ..... 273/243

[58] Field of Search ..... 273/243, 288

[56] References Cited

U.S. PATENT DOCUMENTS

| | | | |
|---|---|---|---|
| 3,649,021 | 3/1972 | Hayes | 273/243 |
| 3,690,667 | 9/1972 | Smith | 273/243 |
| 3,740,038 | 6/1973 | Feulner | 273/243 |
| 3,749,404 | 7/1973 | Oetzel | 273/243 |
| 3,945,643 | 3/1976 | Breslow | 273/243 |
| 4,061,335 | 12/1977 | Breslow | 273/243 |

*Primary Examiner*—Richard C. Pinkham
*Assistant Examiner*—Scott L. Brown
*Attorney, Agent, or Firm*—Allison C. Collard; Thomas M. Galgano

[57] ABSTRACT

A board game apparatus is provided which is especially intended for children and which serves as an instructional aid to promote their awareness of the environment and the problems of environmental pollution. The apparatus includes a game board having a playing field and a multiplicity of spaces formed on the playing field which cooperatively define a continuous closed path along which tokens representing players are moveable in random increments. The multiplicity of spaces includes a first group of spaces having designations thereon indicative of an area of environmental concern, a second group of spaces having monetary penalties specified thereon for harms committed to the environment, and a third and fourth group of spaces having instructions thereon for selecting a card from a specified stack of cards having indicia thereon representative of a benefit or penalty assessed to the player who picks the card. The apparatus further includes a pair of sweeper receptacles and a plurality of sweepers and a supply of play money, the latter two of which are distributed to the players. The object of the game is to be the first player to return all of one's sweepers to the sweeper receptacles without using up one's share of play money.

5 Claims, 8 Drawing Figures

BOARD GAME APPARATUS

The present invention relates to a board game apparatus. More particularly, it relates to a board game apparatus intended especially for children which serves to promote their awareness of the environment and the problems of environmental pollution.

Board and parlor games which are used to simulate various aspects of real life experiences are, of course, well known and widely used, both for entertainment as well as educational purposes. For example, there is the well known Monopoly board game (see U.S. Pat. No. 2,026,082) wherein the players attempt to build real estate monopolies and divest their opponents of their real estate holdings and cash assets. There has also been proposed an antitrust prosecuting board game (see U.S. Pat. No. 3,961,795) wherein the object is to break up monopolies, rather than build them.

Other board games have been proposed which attempt to simulate other aspects of the fields of business, government, etc. However, so far as is known, no board game apparatus is presently available which serves to promote one's awareness of the environment and the causes and effects and ways of combatting environmental pollution. Moreover, no board game apparatus of this type is known which is especially intended as an entertaining instructional aid for young children which promotes their awareness of the environment and man's beneficial or harmful effects thereon, in a relatively simple and yet highly effective manner as herein proposed.

Accordingly, it is an object of the present invention to provide a novel board game apparatus which serves to promote one's awareness of the environment and the problems of environmental pollution.

It is also an object of the present invention to provide such a novel board game apparatus which is both entertaining as well as educational.

It is a further object of the present invention to provide such a novel board game which is relatively easy and simple to play, especially designed for children and which may be economically fabricated.

Certain of the foregoing and related objects are readily-attained according to the present invention by the provision of a board game apparatus which includes a plurality of tokens, each of which represent one of the players and a game board having a playing field and a multiplicity of playing spaces formed on the playing field which cooperatively define a continuous, closed path along which the tokens are moveable in random increments. The multiplicity of spaces includes a starting space, a first group of spaces having designations imprinted thereon indicative of an area of environmental concern, a second group of spaces having monetary penalties specified thereon for harms committed to the environment and a third and fourth group of spaces having instructions imprinted thereon for selecting a card from a specified stack of cards. The apparatus also includes a stack of element cards associated with the third group of spaces and a stack of environment cards associated with the fourth group of spaces, each of which has indicia thereon representative of a benefit or penalty assessed to the player who picks the card. Random number generating means are also provided for randomly determining the number of spaces a player's token will be moved during his turn. Also included is a supply of play money of different denominations, a portion of which is distributed to each of the players, and a multiplicity of playing pieces representing sweepers, which are initially evenly distributed to each of the players. In addition, a plurality of sweeper receptacles, mountable upon the playing field, in which the playing pieces representing sweepers are insertable are also provided.

Preferably, the random number generating means includes a pair of dice, and the tokens are colored differently. The multiplicity of spaces advantageously includes a fifth group of spaces having indicia thereon indicative of a penalty or benefit assessed to the player whose token lands on one of the spaces relative to the acquisition or forfeiture of one playing piece representing a sweeper.

In a preferred embodiment of the invention, the multiplicity of spaces comprises a total of thirty-four generally rectangular spaces which cooperatively define a generally rectangular closed continuous path. Most desirably, the first group of spaces have illustrations thereon indicative of the area of environment concern to which they pertain and the playing pieces representing sweepers are shaped as brooms. Finally, it is especially preferred that the supply of play money includes bills of twenty-five, fifty and one-hundred dollar denominations.

Other objects and features of the present invention will become apparent from the following detailed description considered in connection with the accompanying drawings which disclose one embodiment of the invention. It is to be understood, however, that the drawings are designed for the purpose of illustration only and not as a definition of the limits of the invention.

In the drawing, wherein similar reference characters denote similar elements throughout the several views.

Figure 1:
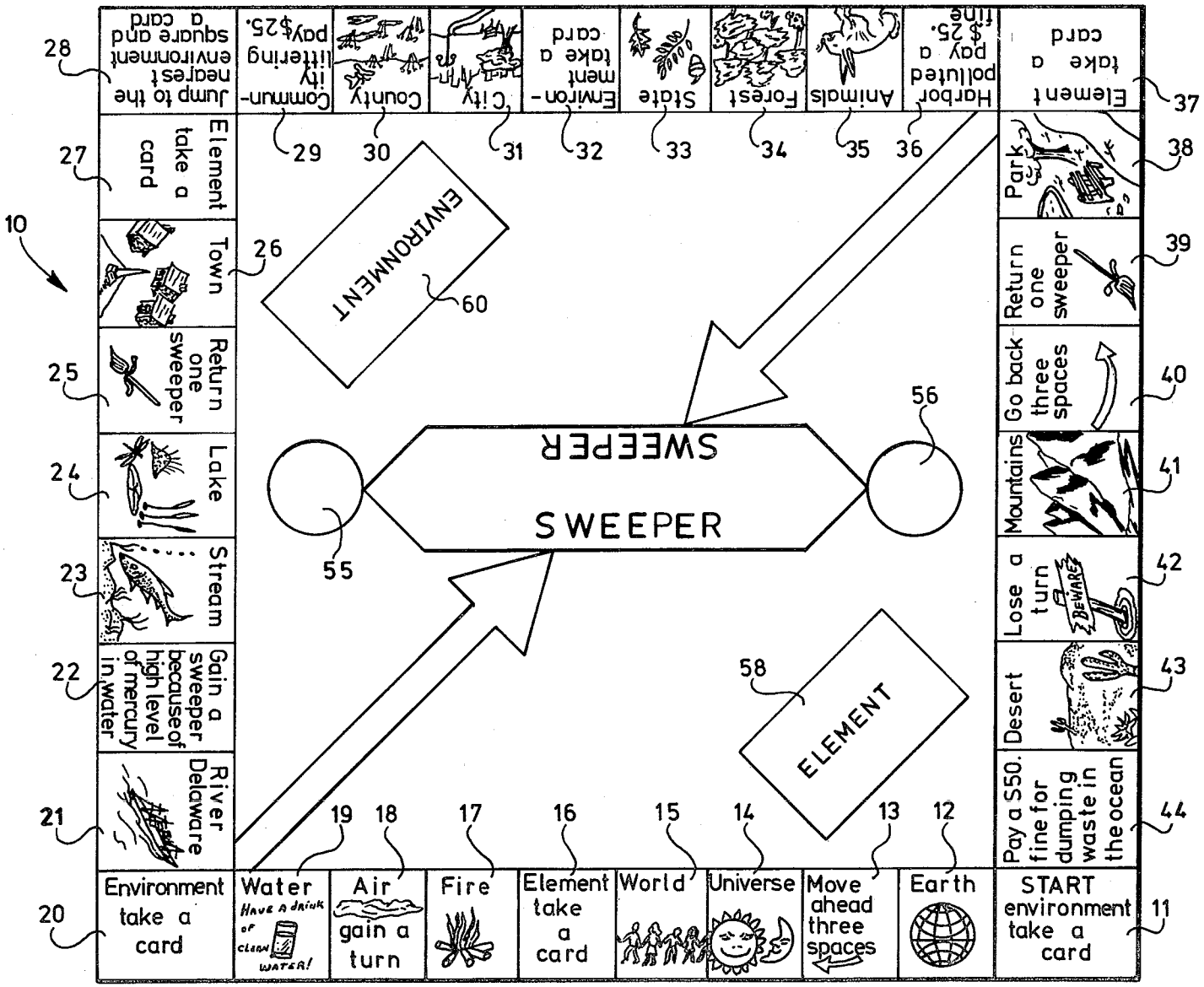
FIG. 1 is a top plan view of the game board used in association with the novel board game apparatus embodying the present invention.

Referring now in detail to the drawings and, in particular FIG. 1 thereof, therein illustrated is a novel board game apparatus embodying the present invention which includes a rectangular, flat game board 10, preferably made of recycled paper or paperboard. Game board 10 has delineated thereon a continuous closed path about the periphery thereof defined by thirty-four playing spaces 11–44.

Board 10 includes a corner starting space 11 labeled "START" which also is marked "ENVIRONMENT-TAKE A CARD", three spaces 16, 27, and 37 labeled "ELEMENT-TAKE A CARD", and two spaces 20 and 32 labeled "ENVIRONMENT-TAKE A CARD". Board 10 also includes a corner space 28 diagonally opposite starting space 11 labeled "JUMP TO THE NEAREST ENVIRONMENT SQUARE AND TAKE A CARD", two spaces 25 and 39 labeled "RETURN ONE SWEEPER" and one space 22 labeled "GAIN ONE SWEEPER BECAUSE OF HIGH MERCURY LEVEL FOR FISH IN THE WATER". There are also two spaces 13 and 40 labeled respectively "MOVE AHEAD THREE SPACES" and "GO BACK THREE SPACES" and two spaces 18 and 42 labeled respectively "AIR-GAIN A TURN" and "LOSE A TURN". In addition, there are three penalty spaces 29, 36 and 44, labeled "COMMUNITY LITTERING PENALTY PAY $25.00", "HARBOR POLLUTED PAY A $25.00 PENALTY", and "PAY A $50.00 FINE FOR DUMPING WASTE IN THE OCEAN", respectively. The remaining spaces each bear the name of an area of environmental concern (i.e., desert, mountains, park, forests, lakes, etc.) and also a symbol or illustration representing the specific area.

Figure 5:
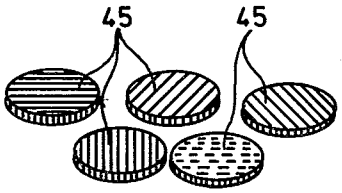
FIG. 5 is a perspective view of five tokens which are playing pieces used to represent each of the players.

Each of the players is represented by a plastic, disc-shaped player piece, marker or token 45 for registering movement along the spaces 11–44 of the path, five of which are shown in FIG. 5. Each token 45 is of a different color (e.g., red, blue, yellow, green, etc.) so that each player's movement along the path may be readily identified without confusion. It should, of course, be appreciated that other types of tokens may be employed so long as they are readily distinguishable from one another, such as by color, configuration, etc.

Figure 6:
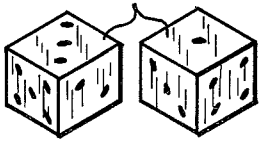
FIG. 6 is a perspective view of a pair of dice used in association with the game board.

Any suitable random-number generating means may be included with the game for indicating the length or extent of a player's move along the path as each player takes his turn at play. Preferably, a pair of dice 46 (FIG. 6) is employed, the number appearing on which after a roll by a player, determines the number of spaces across which the player's token is moved.

There are also three stacks of play money 47, 48 and 49 of different denominations (i.e., twenty-five, fifty and hundred dollars, respectively) supplied with the game which are also differently colored according to denomination (e.g., silver, blue and red) for ready identification. Preferably, there is a total of seventeen one-hundred dollar bills 49, twenty-five fifty dollar bills 48 and thirty-nine twenty-five dollar bills 47 making a total of $3,925.00, which money is partially distributed to each of the players at the beginning of play (as will be discussed in greater detail hereinafter).

Figure 2:
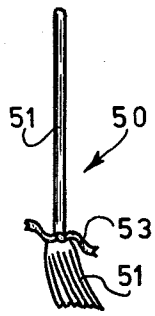
FIG. 2 is a perspective view of one of the sweepers used in association with game board.
Figure 3:
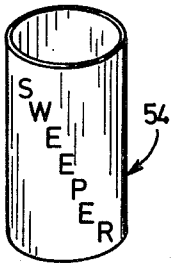
FIG. 3 is a perspective view of one of the sweeper receptacles used in association with the game board.
Figure 4:
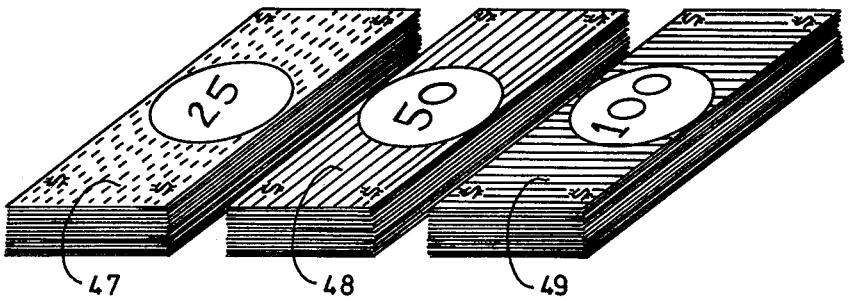
FIG. 4 is a perspective view of three stacks of differently-valued play money used in association with the game board.

The board game apparatus further includes a plurality (preferably two) white colored, sweeper receptacles 54, one of which is shown in FIG. 3, which have imprinted thereon the word "SWEEPER" and a multiplicity (preferably seventy) of sweepers or brooms 50, (one of which is shown in FIG. 2). Sweepers 50 are each preferably made with a white handle 51, and a brown bristle base 52 and are further provided with a bow 53 at the base of handle 51 made of yellow yarn. The two sweeper receptacles are each placed on one of the circles 55 and 56 imprinted on board 10 inwardly of playing spaces 11–44 and a certain number of sweepers 50 are distributed to each player at the beginning of the game, as will be discussed in greater detail hereinbelow.

Figure 7:
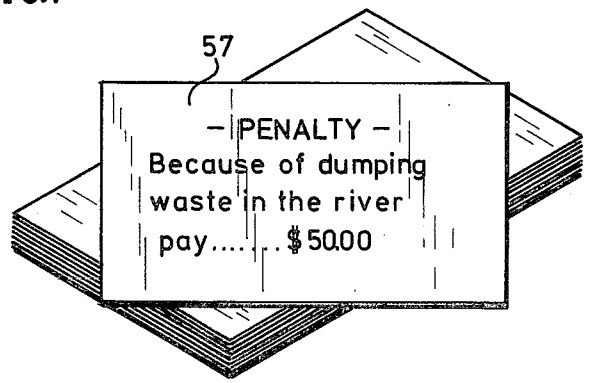
FIG. 7 is a perspective view of a stack of Element cards used in association with the game board.

In addition there are also provided a total of forty-seven Element cards 57 (FIG. 7) which are placed in a stack on box 58 imprinted on board 10. One of the Element cards 57, is picked from the stack by a player when his token lands on one of spaces 16, 27 or 37. Element cards 57 each contain instructions for the player to follow who picks the card. The instructions which each of the Element cards 57 contain are listed below in Table I.

TABLE 1

CONTENTS OF ELEMENT CARDS

| CARD NO. | INSTRUCTIONS |
|---|---|
| 1 | For not providing for safe drinking water, pay a $25.00 penalty. |
| 2 | Because of supporting programs to manufacture energy saving insulating board from waste cellulose fiber, return one sweeper. |
| 3 | For inventing a novel radioactive waste disposal program, return one sweeper. |
| 4 | For non-support of fuel saving programs, pay penalty of $25.00. |
| 5 | Because of safety violations in industry, pay a $25.00 penalty. |
| 6 | Return two sweepers for conserving energy and turning off lights in rooms that aren't being used. |
| 7 | Penalty for not supporting a program for protection against contamination of drinking water, pay $25.00. |
| 8 | Take one sweeper. |
| 9 | Penalty, because of non-support of a program to monitor toxic chemicals at land disposal sites, pay $25.00. |
| 10 | For not supporting a program for effective treatment of our drinking water, pay a penalty of $25.00. |
| 11 | Because you help to collect aluminum cans for recycling, return one sweeper. |
| 12 | Because of oil spill in the ocean, pay a $100 penalty. |
| 13 | Pay a $25.00 penalty because of inadequate waste treatment system. |
| 14 | For not supporting a program to eliminate the metals found in our water and food, pay a penalty of $25.00. |
| 15 | For not encouraging a study on global environmental trends, pay a $25.00 penalty. |
| 16 | Penalty of $25.00 for not supporting a plan for monitoring environmental exposure of pollutant levels. |
| 17 | Pay a penalty of $25.00 for failure to use new gasoline vapor recovery devices at service stations. |
| 18 | Take another turn. |
| 19 | $50.00 penalty because of radio-active waste spillage. |
| 20 | Penalty for not supporting programs for securing useful information of all the trace elements in water. Pay $25.00. |
| 21 | Because you support ecology practices, return two sweepers. |
| 22 | For helping to eliminate hazards of work-place, return one sweeper. |
| 23 | Penalty of $75.00 for tailpipe emission. |
| 24 | Because of using insecticides harmful to humans, animals, plants, and insects, pay a penalty of $50.00. |
| 25 | Penalty-pay $50.00 because of littering at campgrounds. |
| 26 | Pay a $50.00 penalty for not planning for a clean air program. |
| 27 | Because of not burning trash in containers in the back yard, return one sweeper. |
| 28 | For non-support of preservation and storage program of our nation's water supply, pay a penalty of $25.00. |
| 29 | Pay a penalty of $25.00 because of using toxic pesticides and because of soil pollution. |
| 30 | Penalty of $50.00, because of forest fires. |
| 31 | Pay a penalty of $125.00 because of air pollution. |
| 32 | For not providing informaton to workers about potential dangers to their health, pay a penalty of $25.00. |
| 33 | Because of supporting a plan to mix garbage with manure for composting purposes, return one sweeper. |
| 34 | Because of littering in the park, pay a |

TABLE 1-continued

| CARD NO. | CONTENTS OF ELEMENT CARDS INSTRUCTIONS |
|---|---|
| | $100.00 penalty. |
| 35 | Penalty for not encouraging the banning of all non-essential uses of aerosol spray, pay $25.00. |
| 36 | Because of not controlling the noise level in your community, pay a $50.00 penalty. |
| 37 | Penalty - because of not having adequate sewerage treatment plants. Pay $50.00. |
| 38 | Penalty - Ozone injury to plant membranes. Pay $25.00. |
| 39 | Because of having the house temperature at 80 degrees in the winter, take one sweeper. |
| 40 | Pay a penalty of $50.00 for not supporting a program to monitor a drinking water surveillance program. |
| 41 | Take an Environment card. |
| 42 | For failure to use anti-smoke additives in industry, pay penalty of $25.00. |
| 43 | Because of oil slick in the river endangering wildlife, pay a penalty of $100.00. |
| 44 | Penalty - because of dumping waste in the river, pay $50.00. |
| 45 | Penalty of $25.00 for non-support of pollutant removal in coal before, during, and after its use. |
| 46 | Pay a penalty of $50.00 because of atmospheric fallout of air pollutants. |
| 47 | Penalty of $25.00 because of water pollution caused by industry. |

Figure 8:
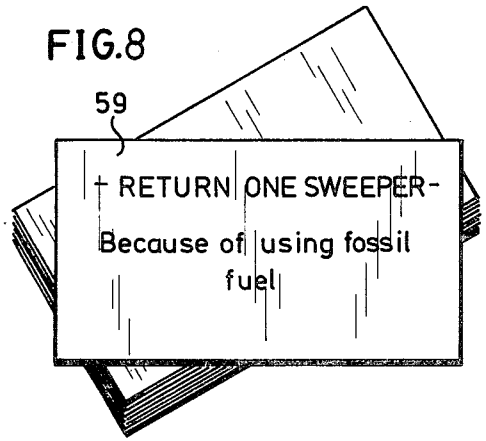
FIG. 8 is a perspective view of a stack of Environment cards used in association with the game board.

There is also provided a total of fifty-three Environment cards 59 (FIG. 8) which are placed in a stack on box 60 imprinted on board 10. One of the environment cards is picked from the stack by a player when his token lands on one of spaces 11, 20 or 32. Environment cards 59 also contain certain instructions for the player to follow who picks the card and the information which each of the Environment cards 59 contain are listed below in Table II.

TABLE II

| CARD NO. | CONTENTS OF ENVIRONMENT CARDS INSTRUCTIONS |
|---|---|
| 1 | Return one sweeper for supporting a program on the quality of water as it comes from our water taps. |
| 2 | For supporting a plan to use electric vehicles to conserve gas, return one sweeper. |
| 3 | Because of preventing forest fires, return one sweeper. |
| 4 | Return one sweeper because of the use of machines geared to scale down sound. |
| 5 | Because of soil conservation, return one sweeper. |
| 6 | Because you saved a tree and used recycled paper, return one sweeper. |
| 7 | Take another turn. |
| 8 | Return one sweeper for the use of plastic in making of future cars geared toward weight reduction for fuel economy. |
| 9 | Return two sweepers because you are interested and involved in the future well-being of water, earth, and air. |
| 10 | For supporting a plan to assess the effects of pollutant levels on the health of children and adults, return one sweeper. |
| 11 | Return two sweepers for encouraging programs to preserve our drinking water quality. |
| 12 | Return one sweeper because of using insulation materials for energy conservation. |
| 13 | Return one sweeper for the improvement of soil in our environment. |
| 14 | Return one sweeper because of using fossil |

TABLE II-continued

| CARD NO. | CONTENTS OF ENVIRONMENT CARDS INSTRUCTIONS |
|---|---|
| | fuel. |
| 15 | Penalty of $25.00 for littering |
| 16 | Move ahead two spaces |
| 17 | For supporting a system to reduce the reddish brown color coming from the exhaust stacks at nitric acid plants, return one sweeper. |
| 18 | For supporting a program to control industrial noise, return one sweeper. |
| 19 | Because of using brick in the design of your home which can gather and store heat from the sun, return one sweeper. |
| 20 | Because of using solar energy for heating purposes, turn in one sweeper. |
| 21 | For supporting a program to preserve the farmlands, return one sweeper. |
| 22 | Return one sweeper for supporting OSHA in industry to combat the onslaught of occupational hazards. |
| 23 | Return two sweepers because workers are aware through instruction and use of safe equipment of potential dangers to their health. |
| 24 | Return two sweepers for supporting programs on determining the effects of pesticides on our environment. |
| 25 | For thinking of ways to save energy when preparing meals, return one sweeper. |
| 26 | Return one sweeper for providing for wildlife preserves. |
| 27 | For supporting new technology in air, liquid and solid waste removal, return two sweepers. |
| 28 | Because of conserving fuel used in autos, return one sweeper. |
| 29 | For supporting a program to gain a better understanding of the relative safety of pesticides to man and the environment now, and in the future, return two sweepers. |
| 30 | Lose a turn because of air pollution. |
| 31 | Return one sweeper for the designing of equipment for air pollution control. |
| 32 | For supporting improvements in industry that can lead to less power consumption, return one sweeper. |
| 33 | For using biodegradable containers, return one sweeper. |
| 34 | Because of recycling used paper, return one sweeper. |
| 35 | For endorsing strict clean air and water regulations, return two sweepers. |
| 36 | Because of helping to keep the noise level down on our highways, turn in one sweeper. |
| 37 | Because of not littering in your community, return one sweeper. |
| 38 | For supporting more parklands and wilderness areas, return one sweeper. |
| 39 | For supporting a plan to harness the thermal energy stored in the oceans, return one sweeper. |
| 40 | Return one sweeper because workers are aware of their working environment. |
| 41 | Take an Element Card. |
| 42 | Because of removing litter from your yard, return two sweepers. |
| 43 | Return one sweeper for the planting of trees to preserve the forests. |
| 44 | Return one sweeper because of removal of contaminates from the air. |
| 45 | Return two sweepers for being aware and supporting programs for our environment in the future. |
| 46 | Return one sweeper because of changing water containing chemical wastes to energy. |
| 47 | Because of not dumping junk in the river, turn in one sweeper. |
| 48 | Because of not polluting the sea and endangering our fish, return one sweeper. |
| 49 | Because of limiting noise from airplanes at nearby airports, turn in one sweeper. |
| 50 | Because of having efficient exhausts on |

TABLE II-continued

| CONTENTS OF ENVIRONMENT CARDS | |
|---|---|
| CARD NO. | INSTRUCTIONS |
| | cars, return one sweeper. |
| 51 | For not supporting a program to help lead the effort to achieve water cleanup goals, take one sweeper. |
| 52 | Due to a lack of support of water chemistry education in high school science program, take one sweeper. |
| 53 | For restoration of stripped minelands, return one sweeper. |

Turning now to the play of the game, initially each player chooses a colored marker 45 and places it on starting space 11. The players will then decide who will be the "Reclaimation" officer who will be in charge of distributing sweepers 50 and the play money 47, 48 and 49. Once this is decided, the "Reclaimation" officer distributes the sweepers and money according to the number of players. If there are two players, each receive fifteen sweepers 50 and a sum of $825.00 in player money consisting of four one hundred dollar bills 49, five fifty dollar bills 48 and seven twenty-five dollar bills 47. If there are three or four players, each player receives twelve sweepers 50 and a sum of $550.00 in play money consisting of two one hundred dollar bills 49, three fifty dollar bills 48 and eight twenty-five dollar bills 47. Although the game is perhaps ideally suited for a maximum of four players, more could of course play with a comparable reduction in the number of sweepers and amount of money distributed or by providing additional sweepers and a greater sum of money with the game.

After the sweepers and money are distributed, the stacks of Element cards 57 and Environment cards 59 are shuffled and placed on their respective boxes 58 and 60 on the board. The two sweeper receptacles 54 are also each placed on one of the circles 55 and 56. The players then each throw the dice to see who shall go first; the player with the highest number goes first, the player with the second highest number goes second, etc.

The first player then picks an Environment card from the stack (as instructed on space 11) and does exactly as the card reads. The first player then throws the dice and moves his token 45 along the spaces according to the number indicated on the dice thrown. If the player throws doubles, he goes again except if he lands on space 42 labeled "LOSE A TURN". The other players then each take their turn in the order randomly chosen before the start of the game.

When a player lands on one of the Environment spaces (11, 20, or 32) or Element spaces (16, 27 or 37), he will take a card from the appropriate stack and do exactly what the card states. If the player lands on either of spaces 25 or 39, he will place one of his sweepers 50 into one of the sweeper receptacles 54. On the other hand, if he lands on space 22, he must take an additional sweeper from one of the sweeper receptacles or from the "Reclaimation" officer. In addition, if the player lands on one of the penalty spaces 29, 36 or 44, he will have to pay the penalty designated to the "Reclaimation" officer, who keeps these penalty sums as well as the other undistributed monies separate from his distributed share of the money. Certain of the Element and Environment cards will also set forth instructions to take and lose sweepers as well as to pay certain specified penalties.

The object of the game is to be the first player to return all of one's sweepers to the sweeper receptacles without using up one's distributed share of money. If a player loses his entire share of money before he returns all of his sweepers, the player is eliminated from the game. Play may continue until the other players return their sweepers without losing all of their money to see who comes in second, third, etc.

It is believed that the game will be particularly suitable for children of the ages eight years and older. It is also believed that the game will take approximately one-half hour to play or less, which is advantageous for children of this age.

While only one embodiment of the present invention has been shown and described, it will be obvious to those persons of ordinary skill in the art, that many changes and modifications may be made thereunto, without departing from the spirit and scope of the invention.

What is claimed is:

1. A board game apparatus, comprising:

a plurality of tokens, each of which represent one of the players;

a multiplicity of playing pieces representing sweepers, which are shaped as brooms and which are initially evenly distributed to each of the players;

a game board having a playing field and a multiplicity of playing spaces formed on said playing field which cooperatively define a continuous, closed path along which said tokens are movable in random increments, said multiplicity of spaces including a starting space, a first group of spaces having illustrations and designations imprinted thereon indicative of an area of environmental concern, a second group of spaces having monetary penalties specified thereon for harms committed to the environment, a third group of spaces having instructions imprinted thereon for selecting a card from a specified stack of cards, a fourth group of spaces having instructions imprinted thereon for selecting a card from another specified stack of cards, and a fifth group of spaces having indicia thereon corresponding to said multiplicity of playing pieces representing sweepers which are shaped as brooms, which spaces are indicative of a penalty or benefit assessed to the player whose token lands on one of the spaces relative to the acquisition or forfeiture of at least one playing piece representing a sweeper;

a stack of element cards associated with said third group of spaces, each of said element cards having indicia thereon representative of a benefit or penalty assessed to the player who picks the card;

a stack of environment cards associated with said fourth group of spaces, each of said environment cards having indicia thereon representative of a benefit or penalty assessed to the player who picks the card;

random number generating means for randomly determining the number of spaces a player's token will be moved during his turn;

a supply of play money of different denominations, a portion of which is distributed to each of the players; and a plurality of sweeper receptacles mountable upon said playing field, in which said playing pieces representing sweepers are insertable.

2. The apparatus according to claim 1, wherein said random number generating means includes a pair of dice.

3. The apparatus according to claim 1, wherein said multiplicity of spaces comprises a total of thirty-four generally rectangular spaces which cooperatively define a generally rectangular closed continuous path.

4. The apparatus according to claim 1, wherein said tokens are differently colored.

5. The apparatus according to claim 1, wherein said supply of play money includes bills of twenty-five, fifty and one hundred dollar denominations.

* * * * *